US005290462A

United States Patent [19]

Habeeb

[11] Patent Number: 5,290,462

[45] Date of Patent: Mar. 1, 1994

[54] LUBRICANT COMPOSITION CONTAINING COMPLEXES OF ALKOXYLATED AMINE, HYDROCARBYLSULFONIC ACID AND ADENINE

[75] Inventor: Jacob J. Habeeb, Westfield, N.J.

[73] Assignee: Exxon Research & Engineering Co., Florham Park, N.J.

[21] Appl. No.: 21,503

[22] Filed: Feb. 22, 1993

[51] Int. Cl.[5] ..... C10M 159/12; C10M 135/10; C07F 3/10

[52] U.S. Cl. ..... 252/47.5; 544/277

[58] Field of Search ..... 252/47.5; 544/277

[56] References Cited

U.S. PATENT DOCUMENTS 3,932,288 1/1976 Hoke ..... 252/47.5

*Primary Examiner*—Jerry D. Johnson
*Attorney, Agent, or Firm*—James H. Takemoto

[57] ABSTRACT

A composition of matter having utility in lubricant formulations, said composition being the reaction product of adenine, alkoxylated amine and hydrocarbylsulfonic acid and having the formula

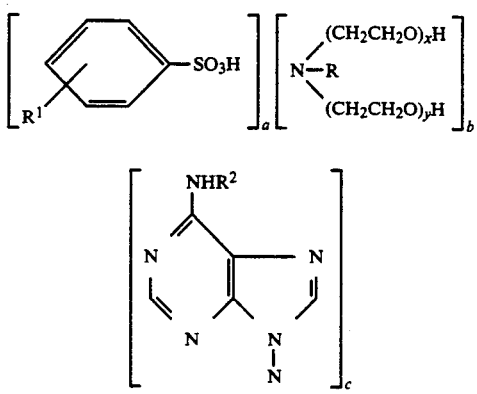

(I)

where R is a hydrocarbyl group of from 2 to 22 carbon atoms, $R^1$ is a hydrocarbyl group of from 2 to 30 carbon atoms, $R^2$ is hydrogen or a hydrocarbyl group of from 1 to 20 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

12 Claims, No Drawings

LUBRICANT COMPOSITION CONTAINING COMPLEXES OF ALKOXYLATED AMINE, HYDROCARBYLSULFONIC ACID AND ADENINE

BACKGROUND OF THE INVENTION

1. Field of the Invention

This invention relates to a composition of matter containing a complex of an alkoxylated amine, hydrocarbylsulfonic acid and adenine and to a lubricating oil composition containing the complex and its use to reduce friction and improve fuel economy in an internal combustion engine.

2. Description of the Related Art

There are many instances, as is well known, particularly under "Boundary Lubrication" conditions where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction. As is also well known, both wear and friction can be reduced, with various degress of success, through the addition of a suitable additive or combination thereof, to a natural or synthetic lubricant. Similarly, continued movement can be insured, again with varying degress of success, through the addition of one or more appropriate additives.

The primary oil additive for the past 40 years for providing antiwear and antioxidant properties has been zinc dialkyldithiophosphate (ZDDP). Oil formulations containing ZDDP, however, require friction modifiers in order to reduce energy losses in overcoming friction. Such energy losses result in lower fuel economy. Moreover, oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns.

It would be desirable to have a lubricating oil composition which provides excellent friction reducing, fuel economy properties and environmentally beneficial (less fuel, i.e., less exhaust emission) properties.

SUMMARY OF THE INVENTION

This invention relates to a novel composition of matter containing a complex of alkoxylated amine, hydrocarbylsulfonic acid and adenine and to an improved lubricating oil composition having improved friction reducing properties which results in improved fuel economy in an internal combustion engine. The composition of matter has the formula (I) and is a complex comprising the reaction product of an alkoxylated amine, hydrocarbylsulfonic acid and adenine, said complex having the formula

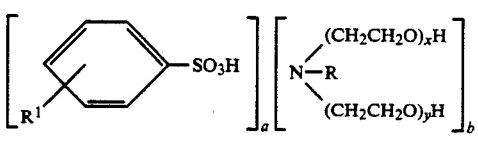

(I)

-continued

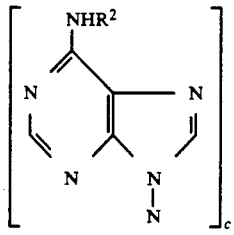

where R is a hydrocarbyl group of from 2 to 22 carbon atoms, $R^1$ is a hydrocarbyl group of from 2 to 30 carbon atoms, $R^2$ is hydrogen or a hydrocarbyl group of 1 to 20 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0. In another embodiment, there is provided a lubricant composition comprising a major amount of a lubricating oil basestock and a minor amount of complex having the formula (I), and a method for reducing friction in an internal combustion engine which comprises operating the engine with a lubricating oil basestock containing an amount effective to reduce friction of a complex having the formula (I).

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen)

without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

In the oil soluble complexes of the present invention having the formula (I) above, R is preferably a hydrocarbyl group of from 6 to 18 carbon atoms, $R^1$ is preferably a hydrocarbyl group of from 2 to 26 carbon atoms and $R^2$ is preferably hydrogen or a hydrocarbyl group of from I to 16 carbon atoms, especially hydrogen. The hydrocarbyl groups include aliphatic (alkyl or alkenyl) and alicyclic group which may be substituted with hydroxy, amino, mercapto and the like and the hydrocarbyl group may be interrupted by oxygen, nitrogen and sulfur. The sum of $x+y$ is preferably 2 to 15, especially 5 to 15.

The complexes of the invention are prepared from the reaction of alkoxylated, preferably propoxylated or ethoxylated, most preferably ethoxylated amines and adenine with alkylsulfonic acid. Ethoxylated and/or propoxylated amines are commercially available from Sherex Chemicals under the trade name Varonic and from Akzo Corporation under the trade names Ethomeen ®, Ethoduomeen ® and Propomeen ®. Examples of preferred amines include ethoxylated (5) cocoalkylamine, ethoxylated (2) tallowalkylamine, ethoxylated (15) cocoalkylamine and ethoxylated (5) soyaalkylamine.

The present hydrocarbylsulfonic acids are commercially available or may be prepared by methods known in the art. Adenine is also commercially available and the secondary amine derivatives prepared by methods known in the art.

The complexes according to the invention are prepared by adding alkylsulfonic acid to a mixture of adenine and alkoxylated amine. Because of the exothermic nature of the reaction, the reaction mixture should be stirred during addition of alkylsulfonic acid.

The precise stoichiometry of the bonding in the complexes of the formula (I) is not known since each molecule in the complex may have several sites which can take part in the hydrogen bonding process either as an acceptor or donor. Because of the multipilicity of bonding possibilities, the molar ratios a:b:c can be varied over a wide range based on the donor/acceptor sites on each of the three molecules and therefore a, b and c in formula (I) are numbers which are not necessarily integral. There exist a total of thirty combinations of interaction sites between the three molecules comprising the complex of the formula (I). For example, a:b:c may be 1:2:1 or 1:1:3 which are just two of the thirty possible combinations.

The lubricant oil composition according to the invention comprises a major amount of lubricating oil basestock and an amount effective to increase fuel economy of the complex of formula (I). Typically, the amount of complex will be from about 0.001 wt % to about 5 wt %, based on oil basestock. Preferably, the amount of complex is from about 0.05 wt % to about 1.0 wt %.

If desired, other additives known in the art may be added to the lubricating oil basestock. Such additives include dispersants, antiwear agents, antioxidants, rust inhibitors, corrosion inhibitors, detergents, pour point depressants, extreme pressure additives, viscosity index improvers, other friction modifiers, hydrolytic stabilizers and the like. These additives are typically disclosed, for example, in "Lubricant Additives" by C. V. Smalhear and R. Kennedy Smith, 1967, pp. 1-11 and in U.S. Pat. No. 4,105,571, the disclosures of which are incorporated herein by reference.

The lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g., methanol) powered engines, stationary powered engines, turbines, and the like.

This invention may be further understood by reference to the following example, which includes a preferred embodiment of this invention.

Example 1

This Example illustrates the preparation of a complex containing ethoxylated amine, alkylsulfonic acid and adenine according to the invention. 41 g of ethoxylated(2)tallowamine and 1 g of adenine were heated to 60° C. with stirring in a 3-neck round bottom flask fitted with a thermometer and a water cooled condenser. 58 g of alkylsulfonic acid having the formula

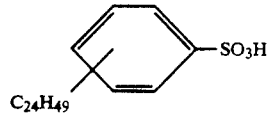

was added gradually to the stirred amine/adenine solution. During addition, the temperature rose to 105° C. due to the exothermic reaction between acid and amine. The reaction mixture was maintained at 105° C. for 1.5 hours and then cooled to room temperature. The reaction mixture was a complex according to the invention and was used without further purification.

EXAMPLE 2

The complex containing ethoxylated amine, alkylsulfonic acid and adenine is an effective friction modifier as shown in this example. The Ball on Cylinder (BOC) friction tests were performed using the experimental procedure described by S. Jahanmir and M. Beltzer in ASLE Transactions, Vol. 29, No. 3, p. 425 (1985) using a force of 0.8 Newtons (1 Kg) applied to a 12.5 mm steel ball in contact with a rotating steel cylinder that has a 43.9 mm diameter. The cylinder rotates inside a cup containing a sufficient quantity of lubricating oil to cover 2 mm of the bottom of the cylinder. The cylinder was rotated at 0.25 RPM. The friction force was continuously monitored by means of a load transducer. In the tests conducted, friction coefficients attained steady state values after 7 to 10 turns of the cylinder. Friction experiments were conducted with an oil temperature of 100° C. Various amounts of complex prepared in Example 1 were added to solvent 150 N. The results of BOC friction tests are shown in Table 1.

TABLE 1

| Wt % of Ethoxylated(2)Tallowamine, Alkylsulfonic Acid and Adenine Complex in Solvent 150N* | Coefficient Of Friction |
|---|---|
| 0.00 | 0.32 |
| 0.1 | 0.20 |
| 0.2 | 0.18 |
| 0.3 | 0.13 |
| 0.5 | 0.10 |
| 0.8 | 0.07 |
| 1.0 | 0.06 |

*S150 is a solvent extracted, dewaxed, hydrofined neutral lube base stock obtained from approved paraffinic crudes (viscosity, 32 cSt at 40° C., 150 Saybolt seconds)

As can be seen from the results in Table 1, as little as 1.0 wt % of complex shows an 81% decrease in the coefficient of friction. These results demonstrate that the present complexes are capable of significant reductions in the coefficient of friction of a lubricant basestock which results in less friction and hence greater fuel economy when the lubricated oil is used in an internal combustion engine.

What is claimed is:

1. A composition of matter comprising a complex which is the reaction product of adenine, alkoxylated amine and hydrocarbylsulfonic acid, said complex having the formula

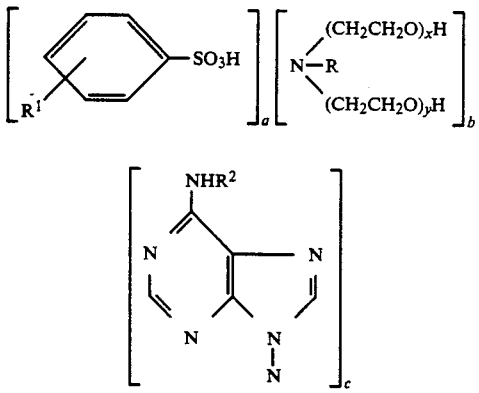

(I)

where R is a hydrocarbyl group of from 2 to 22 carbon atoms, $R^1$ is a hydrocarbyl group of from 2 to 30 carbon atoms, $R^2$ is hydrogen or a hydrocarbyl group of 1 to 20 carbon atoms, x and y are each independently integers of from 1 to 15 with the proviso that the sum of x +y is from 2 to 20, and a, b and c are independent numbers from 1.0 to 3.0 wherein the ratios between a:b, a:c and b:c range from 1.0:3.0 to 3.0:1.0.

2. The composition of claim 1 wherein R is alkyl or alkenyl of from 6 to 18 carbon atoms.

3. The composition of claim 1 wherein $R^1$ is a hydrocarbyl group of from 2 to 26 carbon atoms.

4. The composition of claim 1 where $R^2$ is hydrogen.

5. The composition of claim 1 wherein x+y is from 2 to 15.

6. A lubricant oil composition which comprises:

(a) a major amount of a lubricant oil basestock, and (b) a minor amount of a complex which is a reaction product of an alkoxylated amine, hydrocarbylsalicylic acid and adenine, said complex having the formula:

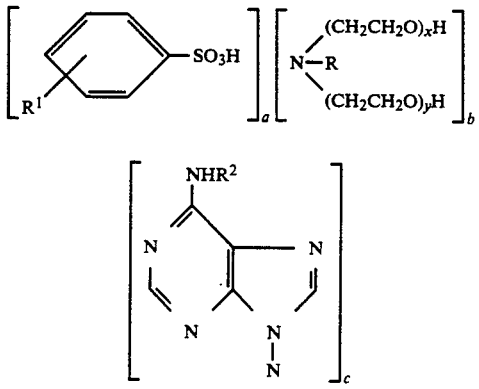

(I)

where R is a hydrocarbyl group of from 2 to 22 carbon atoms, $R^1$ is a hydrocarbyl group of from 2 to 30 carbon atoms, $R^2$ is hydrogen or a hydrocarbyl group of from 1 to 20 carbon atoms, x and y are each independently integers of from 1 to 15 with the proviso that the sum of x +y is from 2 to 20, and a, b and c are independent numbers from 1.0 to 3.0 wherein the ratios between a:b, a:c and b:c range from 1.0:3.0 to 3.0:1.0.

7. The lubricant composition of claim 6 wherein R is alkyl or alkenyl of from 6 to 18 carbon atoms.

8. The lubricant composition of claim 6 wherein $R^1$ is a hydrocarbyl group of from 2 to 26 carbon atoms.

9. The lubricant composition of claim 6 where $R^2$ is hydrogen.

10. The lubricant composition of claim 6 wherein x+y is from 2 to 15.

11. The lubricant composition of claim 6 wherein the amount of complex is from about 0.001 to about 5 wt. %, based on oil basestock.

12. A method for reducing friction in an internal combustion engine which comprising operating an internal combustion engine with the lubricating oil composition of claim 6.

* * * * *